US005782708A

United States Patent [19]

Kimball, Jr.

[11] Patent Number: 5,782,708

[45] Date of Patent: Jul. 21, 1998

[54] RETRACTABLE GOLF TOOL

[76] Inventor: Madison D. Kimball, Jr., 202 Southgate Dr., Hot Springs, Ark. 71913

[21] Appl. No.: 917,482

[22] Filed: Aug. 26, 1997

[51] Int. Cl.[6] ..... A63B 57/00

[52] U.S. Cl. ..... 473/408; 224/918

[58] Field of Search ..... 413/406, 408, 413/387, 283, 284, 285, 286, 138, 139, 142, 147; 224/918

[56] References Cited

U.S. PATENT DOCUMENTS 4,736,877 4/1988 Clark ..... 473/406
4,884,805 12/1989 Patterson ..... 473/408
5,211,395 5/1993 Liao ..... 473/406
5,372,362 12/1994 Barker ..... 473/406

*Primary Examiner*—Steven B. Wong
*Attorney, Agent, or Firm*—Spencer & Frank

[57] ABSTRACT

A golfing tool for repairing golf ball divots. The device comprises a divot repair tool attached to a retractable cord emerging from a housing. The divot repair tool is retracted back to the device after use by the golfer. A fastener, such as a belt clip or an alligator clip, attaches the device to the golfer's clothing. Furthermore, channels in the body receive golf tees and a ball marker is releasably attached to either the divot repair tool or the housing.

11 Claims, 2 Drawing Sheets

RETRACTABLE GOLF TOOL

BACKGROUND OF THE INVENTION

1. Field of the Invention

The invention relates to a golfing tool used for repairing golf ball divots, comprising a divot repair tool with a pronged portion.

2. Description of the Prior Art

Divots caused by golf balls upon impact with the green are a common problem in the game of golf and detract from the golf course quality. Divot repair tools are well known in the art and are used to repair these indentations. The golfer pushes prongs on the divot repair tool into the ground next to the divot. The tool is then tilted back, propping the turf to its original shape.

Because of its small size and frequent use, a divot repair tool is often placed in the golfer's pocket. Unfortunately, dirt and grass picked up by the tool also ends up in the golfer's pocket, causing permanent stains after repeated use. Staining problems may also lead some golfers to forgo utilizing divot repair tools, which in turn lowers the quality of the green.

Many types of divot repair tool holders are known in the art. These carrying devices, however, require the golfer to insert the tool back in its holder instead of the golfer's natural tendency to place the tool in a pant pocket. The golfer can easily forget to place the divot repair tool back in its holder, instead placing it in a pocket and staining the pants.

SUMMARY OF THE INVENTION

An object of this invention is to prevent grass and dirt picked up by a divot repair tool from soiling clothing. Another object of this invention is to increase use of divot repair tools, which would therefore increase the quality of golf courses. The invention is also intended to make repairing divots more convenient and enjoyable, and make the divot repair tool more accessible to the golfer.

The above and other objects of the invention are accomplished according to the invention by the provision of a golf tool including: a housing; a fastener connected to the housing for releasably fastening the housing to a golfer's apparel; a retractable cord mechanism mounted in the housing and presenting a retractable cord with an end emerging from the housing; and a divot repair tool including a pair of prongs secured to the end of the cord.

By employing a retractable cord attached to a divot repair tool, the tool is retracted back to the tool carrier, preventing the golfer from placing the tool in a pant pocket. A fastener attachable to the golfer's clothing keeps the device readily accessible during play.

According to further aspects of the invention, a golf tee holder and a ball marker may be incorporated into the golf tool. Golf tees may be inserted into channels in a body of the device which snugly hold the tees. A ball marker, used to mark the position of golf balls, can be releasably attached to a portion of the golf tool.

DESCRIPTION OF THE PREFERRED EMBODIMENTS

A detailed description of the construction and use of the device is given below, with reference being made to the drawings, wherein the same reference numbers are utilized throughout to refer to common elements.

Figure 1:
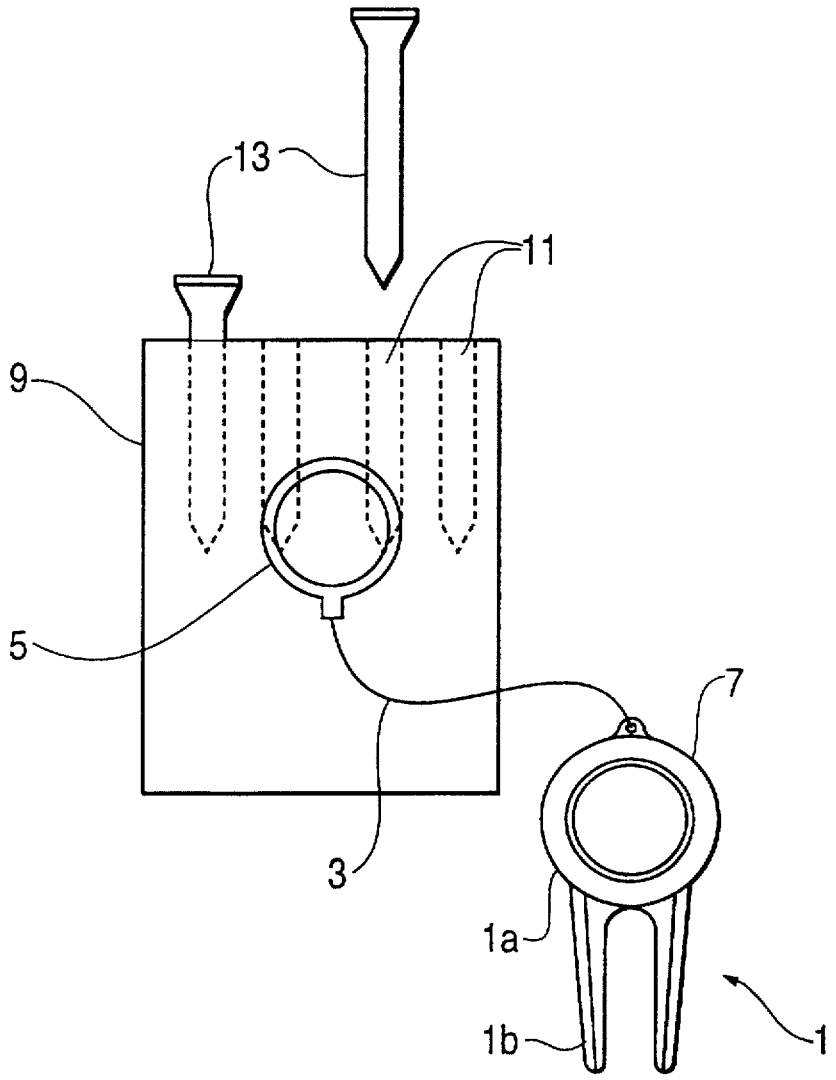
FIG. 1 is a front elevation view of a golf tool according to the invention.
Figure 2:
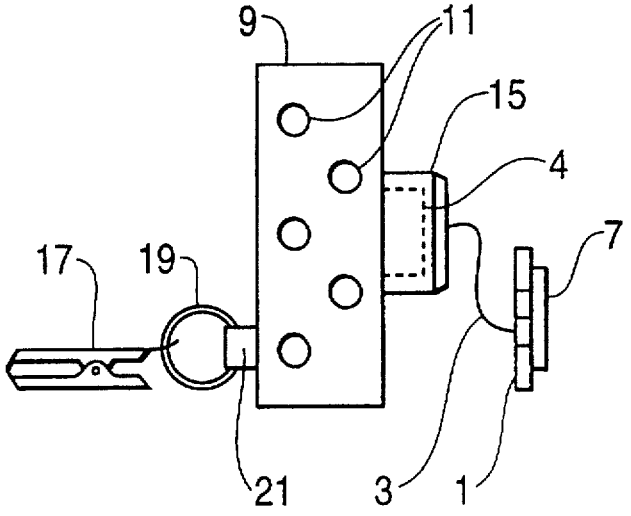
FIG. 2 is a top elevation view of the golf tool of FIG. 1 utilizing an alligator clip as a fastener.

A front view of one embodiment of the invention is shown in FIG. 1. A divot repair tool 1 is attached to a length of retractable cord 3 originating from a retractable cord mechanism 4 (shown in FIG. 2 with dotted lines) contained in a housing 5. A ball marker 7 is magnetically attached to the divot repair tool 1 as shown in FIG. 1. The housing 5 is mounted on a body 9 which may contain several channels 11 designed to hold golf tees 13. FIG. 2 shows an alligator clip 17 looped to the body 9 through a key ring 19 to form a fastener for securing the device on a golfer's apparel.

Referring back to the FIG. 1, the divot repair tool 1 includes a head end **1*a* and a pair of prongs 1*b* extending from the head end. In order to permit the prongs to penetrate the ground, the divot repair tool 1 is comprised of a rigid material such as a metal or a hard plastic. It is also possible to add a painted or plated finish to the divot repair tool 1** in order to prevent rusting.

The retractable cord 3 connecting the divot repair tool 1 to the housing 5 is constructed from a flexible and resilient material such as a synthetic string or a thin metallic chain. The retractable cord 3 should be long enough (for example, from 24 to 26 inches) to allow a golfer to pull the divot repair tool 1 down to the nearby ground when the device is fastened to the golfer's clothing.

The retractable cord 3 is connected to the retractable cord mechanism 4 inside the housing 5. The retractable cord mechanism can comprise a conventional spring actuated mechanism for drawing back a length of cord pulled from an internal spool.

FIG. 1 depicts a ball marker 7 attached to the divot repair tool 1. A ball marker, well known in the art, is used to represent a golf ball's position on the green when the ball needs to be temporarily removed. The ball marker 7 can be attached to the divot repair tool 1 by means of magnetic attraction, a snap fastener, or similarly known means of releasably securing two objects together.

The housing 5 is mounted to the body 9 which contains a plurality of channels 11. The housing 5 can be constructed from a wide variety materials known to those skilled in the art. The channels are constructed to hold golf tees 13 securely in place, and may be lined with materials to increase friction between the golf tees 13 and the body 9.

In FIG. 2, an alligator clip 17 and key ring 19 is attached to a loop connection 21 on the body 9 to fasten the device onto a golfer's apparel or golf bag. Once the device is fastened, the divot repair tool is easily accessible.

Figure 3:
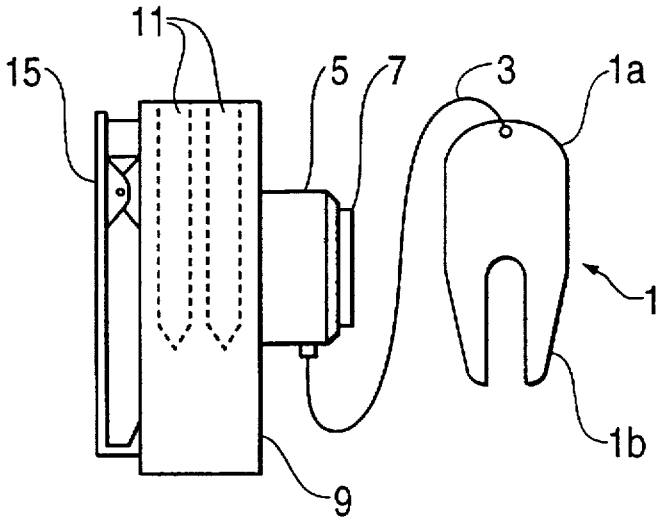
FIG. 3 is a side elevation view of another embodiment of the invention utilizing a belt clip as a fastener.

According to anther embodiment of the invention show in FIG. 3, a belt clip 15 may be used in place of the alligator clip 17 and key ring 19. The belt clip 15 comprises a spring loaded clasp which presses clothing between the clasp and the body 9.

The head end **1*a* of the divot repair tool 1 may be constructed to include other known implements such as a bottle opener, a spike wrench, a club face grove cleaner, a scraper, a golf ball roundness checker, and the like. Finally, the device can be constructed to allow the ball marker 7 to be releasably attached to the housing 5**, as shown in FIG. 3.

To repair an indentation left by a golf ball, the golfer simply pulls the divot repair tool 1 down to the ground in a natural motion. The prongs of the tool are inserted into the ground next to the indentation. The tool is then titled back, removing the divot and restoring the green. The golfer, upon repairing the divot, allows the divot repair tool 1 to be retracted back to its original position on the device by the retractable cord 3. The tool cannot not be placed in the golfer's pocket and therefore prevents dirt and grass from staining the golfer's clothing.

Likewise, the golf tees 13 can be conveniently removed from and placed into the channels 11 of the device by the golfer throughout play. The ball marker 7 is also made available to the golfer and is releasably attached to the device as previously stated.

The invention now being fully described, it will be apparent to one of ordinary skill in the art that any changes and modifications can be made thereto without departing from the spirit or scope of the invention as set forth in the appended claims.

What is claimed is:

1. A golf tool, comprising:

a housing;

a fastener connected to the housing for releasably fastening the housing to a golfer's apparel;

a retractable cord mechanism mounted in the housing and presenting a retractable cord with an end emerging from the housing; and a divot repair tool including a pair of prongs secured to the end of the cord.

2. The golf tool of claim 1, further comprising a body including a plurality of channels for receiving golf tees, with the housing and the fastener attached the body.

3. The golf tool of claim 2, wherein the housing and the body comprise an integral unit.

4. The golf tool of claim 1, further comprising a ball marker releasably attached to the divot repair tool.

5. The golf tool of claim 1, further comprising a ball marker magnetically attached to the divot repair tool.

6. The golf tool of claim 1, wherein the divot repair tool comprises metal.

7. The golf tool of claim 1, wherein the divot repair tool comprises hard plastic.

8. The golf tool of claim 1, wherein the fastener comprises a belt clip.

9. The golf tool of claim 1, wherein the fastener comprises a key ring connected to the housing and an alligator clip attached to the key ring.

10. The golf tool of claim 1, further comprising a ball marker releasably attached to the housing.

11. The golf tool of claim 1, further comprising a ball marker magnetically attached to the housing.

* * * * *